US007154226B2

(12) United States Patent
Boomkens et al.

(10) Patent No.: US 7,154,226 B2
(45) Date of Patent: Dec. 26, 2006

(54) CAPPED ELECTRIC LAMP AND LOW-PRESSURE MERCURY-VAPOR DISCHARGE LAMP

(75) Inventors: Allard Arend Boomkens, Roosendaal (NL); Frank Gerardus Cornelis De Bot, Roosendaal (NL); Diederik Ten Horn, Roosendaal (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 37 days.

(21) Appl. No.: 10/517,916

(22) PCT Filed: May 27, 2003

(86) PCT No.: PCT/IB03/02322

§ 371 (c)(1),
(2), (4) Date: Dec. 14, 2004

(87) PCT Pub. No.: WO03/107376

PCT Pub. Date: Dec. 24, 2003

(65) Prior Publication Data

US 2006/0082310 A1 Apr. 20, 2006

(30) Foreign Application Priority Data

Jun. 18, 2002 (EP) ..... 02077440

(51) Int. Cl.
*H01J 17/18* (2006.01)

(52) U.S. Cl. ..... 313/623; 313/318.02

(58) Field of Classification Search ..... 439/611; 313/623–625, 318.02–318.08, 56, 636, 634
See application file for complete search history.

(56) References Cited

U.S. PATENT DOCUMENTS 2,680,236 A * 6/1954 Kuebler ..... 439/617
6,465,960 B1 * 10/2002 Van Duivendijk et al. .... 315/56

* cited by examiner

*Primary Examiner*—Karabi Guharay
*Assistant Examiner*—Dalei Dong

(57) ABSTRACT

A capped electric lamp has a light-transmitting lamp vessel accommodating an electrical element and a lamp cap provided with a projecting contact pin (4). An indentation (15) is formed in the contact pin (4) to fix the current-supply conductor (5). According to the invention, the indentation (15) comprises a weakening portion (16) for weakening the current-supply conductor (5) during the manufacture of the electric lamp and comprises a fixation portion (18) for fixing the current-supply conductor (5) in the contact pin (4), wherein said weakening and fixation portion are substantially parallel to each other. Preferably, the indentation (15) comprises a narrow portion (17) between the weakening portion (16) and the fixation portion (18) which is relatively narrow compared with the weakening portion (16) and the fixation portion (18).

20 Claims, 3 Drawing Sheets

CAPPED ELECTRIC LAMP AND LOW-PRESSURE MERCURY-VAPOR DISCHARGE LAMP

The invention relates to a capped electric lamp comprising:

- a light-transmitting lamp vessel accommodating an electrical element;
- a lamp cap provided with a projecting contact pin having a longitudinal axis, which lamp cap is secured to the lamp vessel;
- a current-supply conductor which is connected to the electrical element and to the contact pin;
- an indentation being formed in the contact pin to fix the current-supply conductor.

The invention also relates to a low-pressure mercury vapor discharge lamp comprising such a capped electric lamp.

An electric lamp as described in the opening paragraph is disclosed in WO-A 01/63 638 (PH-NL 00 00 56). In the known lamp, the indentation has a "pinch" or weakening portion for weakening the current-supply conductor through deformation of the contact pin during manufacture of the electric lamp. Said weakening portion encloses an angle with a longitudinal axis parallel to the contact pin. In addition, the indentation has a fixation portion for fixing the current-supply conductor in the contact pin.

The known capped electric lamp is a low-pressure mercury vapor discharge lamp, generally having two contact pins at the lamp cap. In a low-pressure mercury vapor discharge lamp, mercury is the primary component for (efficiently) generating ultraviolet (UV) light. An inner wall of the discharge vessel may be coated with a luminescent layer comprising a luminescent material for converting UV to other wavelengths, for example to UV-B and UV-A for tanning purposes, or to visible radiation for general illumination purposes. In that case the low-pressure mercury vapor discharge lamp is also denoted a fluorescent lamp. In an alternative embodiment, the ultraviolet light generated may be used in germicidal lamps (UV-C). The discharge vessel of said low-pressure mercury vapor discharge lamps is generally tubular with a circular cross-section and includes both elongated and compact embodiments.

During indentation of the capped electric lamp an indentation tool is used which has a weakening part which makes the weakening portion of the indentation and a fixation part which makes the fixation portion of the indentation. The indentation tool is pressed against the contact pin in a direction transverse to the longitudinal axis, causing the contact pin to be deformed in an inward direction. During fixation of the indentation tool into the contact pin, in particular, said weakening part has a tendency to become damaged easily, for example by breaking off in part or wholly. Due to this breaking-off behavior, the indentation is not provided in the contact pin as desired, which may render the capped electric lamp no longer useful for delivery to clients.

It is an object of the invention to provide a capped electric lamp of the type mentioned in the opening paragraph, wherein said drawback is obviated.

According to the invention, a low-pressure mercury vapor discharge lamp of the kind mentioned in the opening paragraph is for this purpose characterized in that the indentation comprises a weakening portion for weakening the current-supply conductor during the manufacture of the electric lamp and comprises a fixation portion for fixing the current-supply conductor in the contact pin, and in that the weakening portion and the fixation portion of the indentation are substantially parallel to each other.

The indentation in the contact pin is formed in the course of the manufacture of the electric lamp by an inward deformation of the contact pin. In the known capped electric lamp, the weakening portion encloses an angle with the fixation portion of approximately 25° to 45° such that part of the weakening portion lies deeper in the contact pin. This means that the forces exerted on the weakening part of the indentation tool are relatively high with respect to those exerted on the fixation part. A positioning of the weakening portion and the fixation portion of the indentation substantially parallel to each other serves to balance this difference between the exerted forces.

A preferred embodiment of the capped electric lamp in accordance with the invention is characterized in that the indentation between the weakening portion and the fixation portion comprises a narrow portion which is relatively narrow compared with the weakening portion and the fixation portion. This narrow portion allows the material of the contact pin which is deformed during fixation to flow away. In this manner the forces exerted on the wire during indentation differ as a function of their location in the indentation. The current-supply conductor is thicker in the location of the narrow portion in the indentation than in the location of the weakening portion and in the location of the fixation portion.

The combination of the weakening portion, the fixation portion, and the narrow portion has a synergetic effect. The weakening portion weakens the current-supply conductor upon indenting the contact pin, and the fixation portion causes the current-supply conductor to be fixed in the contact pin such that the end portion of the current-supply conductor can be readily tom off without the fixation of the current-supply conductor being substantially reduced. In addition, the narrow portion allows the material of the contact pin to flow away during fixation.

In order to balance the forces exerted on the indentation tool during fixation, the narrow portion preferably lies in a plane which also comprises the weakening portion and the fixation portion.

In order to allow the material in the middle of the indentation to flow away readily, the width of the narrow portion should be sufficiently small compared with the width of the weakening portion. To this end, a preferred embodiment of the capped electric lamp in accordance with the invention is characterized in that the ratio of the width $w_{np}$ of the narrow portion to the width $w_{wp}$ of the weakening portion complies with the relation:

$$0.2 \leq \frac{w_{np}}{w_{wp}} \leq 0.5.$$

The width of the narrow portion should not be too small ($w_{np} \geqq 0.2 \times w_{wp}$), otherwise the narrow part of the indentation tool becomes too vulnerable, leading to a premature end of life for the indentation tool. On the other hand, the width of the narrow portion should not be too great ($w_{np} \leqq 0.5 \times w_{wp}$), because then the flowing away of the material of the contact pin during fixation is hampered.

Similarly, in order to allow the material in the middle of the indentation to flow away readily, the width of the narrow portion should be sufficiently small compared with the width of the fixation portion. To this end, a preferred embodiment of the capped electric lamp in accordance with the invention is characterized in that the ratio of the width $w_{np}$ of the narrow portion to the width $w_{fp}$ of the fixation portion complies with the relation:

$$0.2 \leq \frac{w_{np}}{w_{fp}} \leq 0.5.$$

A preferred embodiment of the capped electric lamp in accordance with the invention is characterized in that the ratio of the diameter $d_{ind}$ of the current-supply conductor at the location of the weakening portion in the indentation to the diameter $d_w$ of the current-supply conductor complies with the relation:

$$0.2 \leq \frac{d_{ind}}{d_w} \leq 0.5.$$

The diameter of the current-supply conductor in the indentation should not be too small ($d_{ind} \geqq 0.2 \times d_w$), otherwise the current-supply conductor would tend to break too easily. On the other hand, the diameter of the current-supply conductor in the indentation should not be too large ($d_{ind} \leqq 0.5 \times d_w$), because then the weakening does not have the desired effect, i.e. of allowing the current-supply conductor to break off when a pulling force is exerted on the end of the current-supply conductor projecting from the contact pin, thereby removing the remainder of the current-supply conductor from the contact pin.

A preferred embodiment of the capped electric lamp in accordance with the invention is characterized in that the current-supply conductor in the contact pin does not extend beyond a boundary of the indentation that is furthest removed from the lamp cap. During manufacture of the capped electric lamp, the indentation tool provides an indentation in the contact pin. During its fixation, the current-supply conductor is weakened at the location of the weakening portion to such an extent that, when a pulling force is exerted on the end portion of the current-supply conductor projecting from the contact pin, the current-supply conductor breaks off in a predetermined location. Providing the current-supply conductor with a predetermined weakened portion causes the current-supply conductor to break off near the boundary of the indentation. After breaking-off, the current-supply conductor no longer projects from the contact pin. As a result, cutting and/or filing of the end portion of the current-supply conductor projecting from the contact pin after fixation of the current-supply conductor has become superfluous.

The combination of the weakening portion, the fixation portion and the narrow portion has a synergetic effect. On the one hand, the pinch portion weakens the current-supply conductor during indentation of the contact pin and, on the other hand, the press portion causes the current-supply conductor to be fixed in the contact pin such that the end portion of the current-supply conductor can be readily torn off without the fixation of the current-supply conductor being substantially reduced. To this end, the length of the press portion in the fixation area is preferably chosen to be such that, when the end portion of the current-supply conductor is pulled from the contact pin, the current-supply conductor remains fixed in the contact pin.

It is particularly favorable if the contact pin has only one indentation. This enables the pinch portion and the press portion to be provided in a single operation.

The measure in accordance with the invention is particularly suitable for low-pressure mercury vapor discharge lamps comprising a capped electric lamp in accordance with the invention wherein the lamp vessel encloses a discharge space provided with a filling of mercury and an inert gas in a gastight manner, and wherein the electric element comprises an electrode arranged in the discharge space for maintaining a discharge in said discharge space.

These and other aspects of the invention will be apparent from and elucidated with reference to the embodiment(s) described hereinafter.

In the drawings.

The Figures are purely diagrammatic and not drawn to scale. Particularly for clarity, some dimensions are exaggerated strongly. In the drawings, like reference numerals refer to like parts whenever possible.

Figure 1:
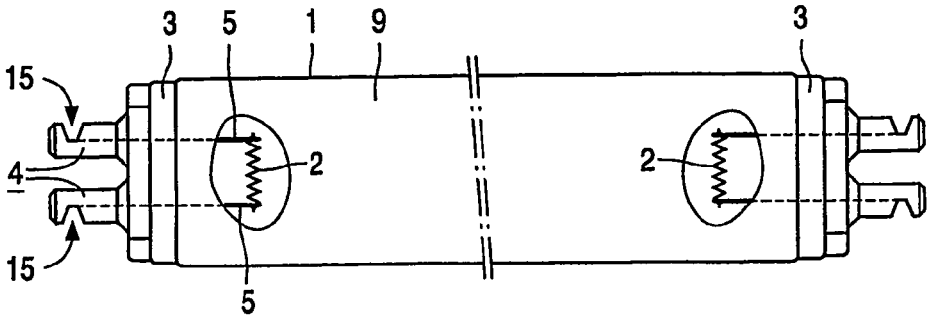
FIG. 1 is a side elevation of a capped electric lamp in accordance with the invention.

FIG. 1 diagrammatically shows the capped electric lamp comprising a light-transmitting lamp vessel 1 accommodating an electric element 2. A lamp cap 3 provided with a projecting contact pin 4 is secured to the lamp vessel 1. A current-supply conductor 5 connects the electric element 2 to the contact pin 4. The contact pin 4 is provided with an indentation 15 (see also FIGS. 2A and 2B) for fixing the current-supply conductor 5 in the contact pin 4. An alternative embodiment of the capped electric lamp is a compact fluorescent lamp.

The lamp shown in FIG. 1 comprises two identical lamp caps 3, which each are provided with two contact-pins 4, said lamp caps being each connected by a respective conductor 5 to the electric element 2. The lamp shown is a low-pressure mercury vapor discharge lamp, wherein the lamp vessel 1 encloses a discharge space 9 containing a filling of mercury and an inert gas in a gastight manner. Preferably, the lamp vessel 1 is coated with a luminescent material (not shown in FIG. 1). The discharge space 9 accommodates two electrodes which serve as the electric element 2 and which can be heated by current passage in order to ignite the lamp and to maintain a discharge in the discharge space 9.

Figure 2A:
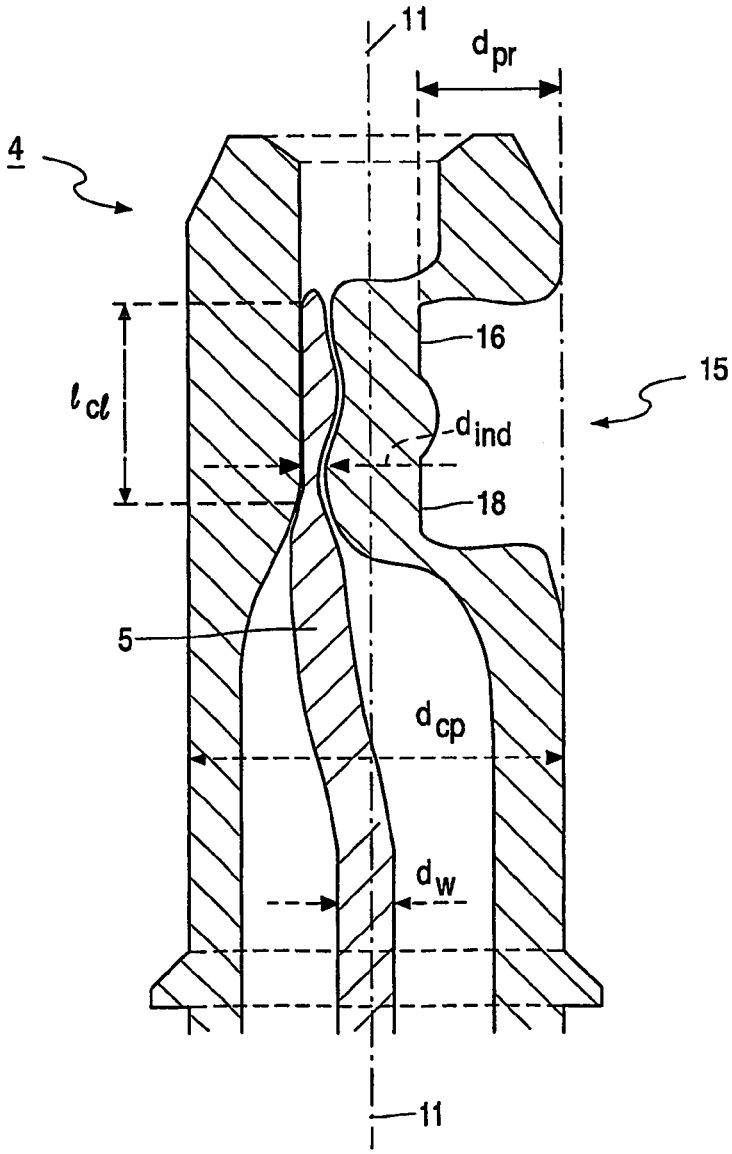
FIG. 2A is a cross-sectional view of a contact pin of the capped electric lamp in accordance with the invention.
Figure 2B:
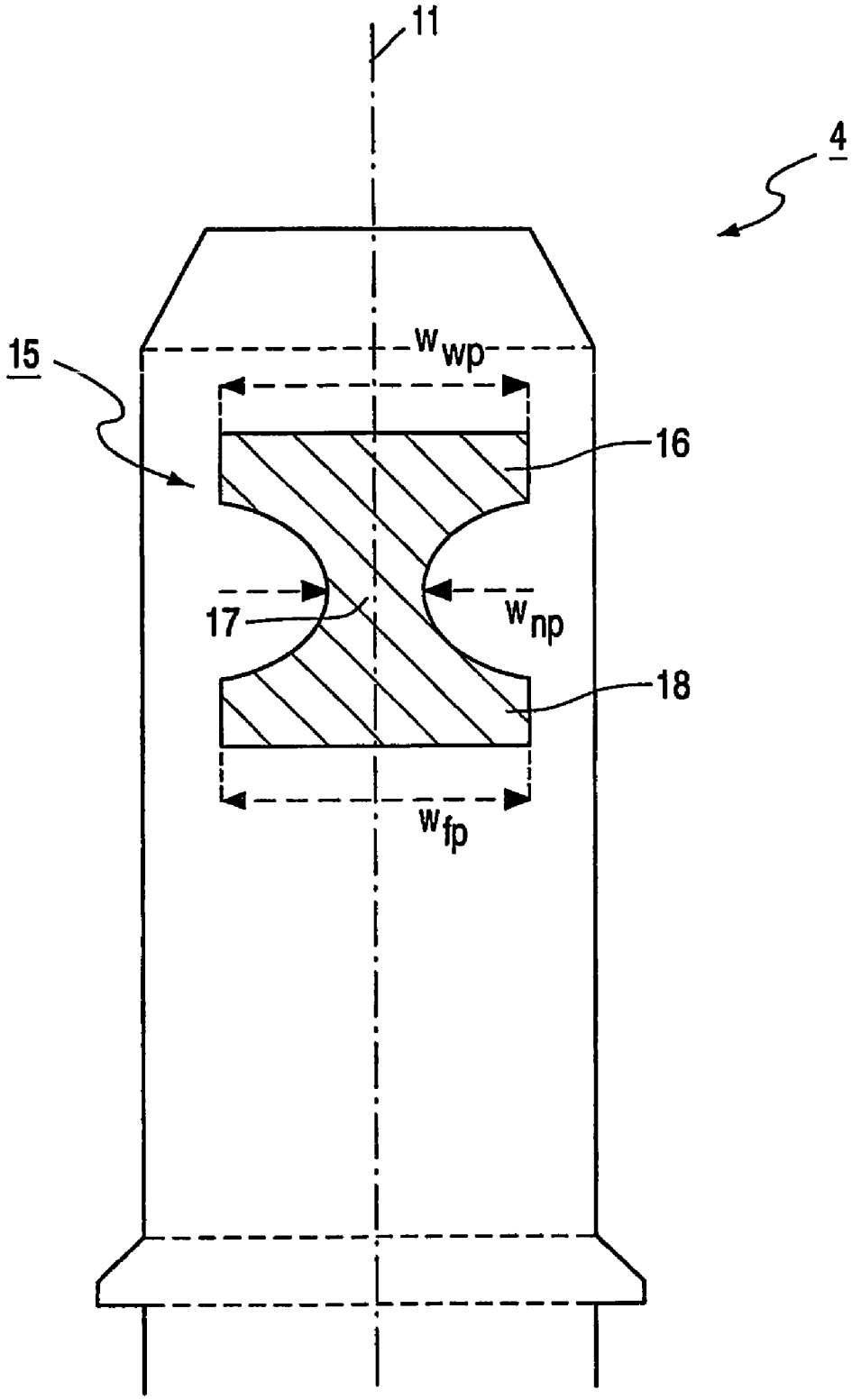
FIG. 2B is a side elevation of the contact pin in FIG. 2A.

FIG. 2A diagrammatically shows in cross-section a detail of the capped electric lamp in accordance with the invention shown in FIG. 1. In addition, FIG. 2B is a diagrammatic side elevation of the contact pin in FIG. 2A. The object in FIG. 2A is rotated through 90° with respect to the longitudinal axis 11 in FIG. 2A. In particular, FIGS. 2A and 2B show a contact pin 4 with a longitudinal axis 11, the current-supply conductor 5 being fixed. The contact pin 4 is unilaterally deformed in an inward direction, an indentation 15 being formed in the contact pin 4. As can be seen from FIG. 2B the indentation is shaped like a diabolo or hourglass.

The indentation 15 comprises a weakening portion 16 for weakening the current-supply conductor 5 during the manufacture of the electric lamp and comprises a fixation portion 18 for fixing the current-supply conductor 5 in the contact pin 4. The substantially flat weakening portion 16 and the substantially flat fixation portion 18 of the indentation 15 are substantially parallel to each other. Owning to the positioning of the weakening portion and the fixation portion of the indentation substantially parallel to each other, the forces exerted on the weakening portion and the fixation portion are balanced during pressing.

Preferably, the indentation 15 between the weakening portion 16 and the fixation portion 18 is provided with a narrow portion 17 which is relatively narrow compared with the weakening portion 16 and the fixation portion 18. This narrow portion allows the material of the contact pin which is deformed during fixation to flow away. Preferably, the narrow portion 17 lies in the same plane as the weakening portion 16 and the fixation portion 18.

Preferably, the ratio of the diameter $d_{ind}$ of the current-supply conductor in the location of the weakening portion in the indentation to the diameter $d_w$ of the current-supply conductor complies the relation (see FIG. 2A):

$$0.2 \leq \frac{d_{ind}}{d_w} \leq 0.5.$$

In order to allow the material in the middle of the indentation 15 to flow away readily, the width $w_{np}$ of the narrow portion 17 should be sufficiently small compared with the width $w_{wp}$ of the weakening portion 16. Preferably, the ratio of $w_{np}$ to $w_{wp}$ complies with the relation (see FIG. 2B):

$$0.2 \leq \frac{w_{np}}{w_{wp}} \leq 0.5.$$

Alternatively, the ratio of the width $w_{np}$ of the narrow portion to the width $w_{fp}$ of the fixation portion complies with the relation:

$$0.2 \leq \frac{w_{np}}{w_{fp}} \leq 0.5.$$

For a typical capped lamp, the width of the narrow portion $w_{np}$ is in the range from 0.25 to 0.75 mm, whereas the width of the weakening portion and the fixation portion is in the range from approximately 1.0 to 1.5 mm.

Figure 3:
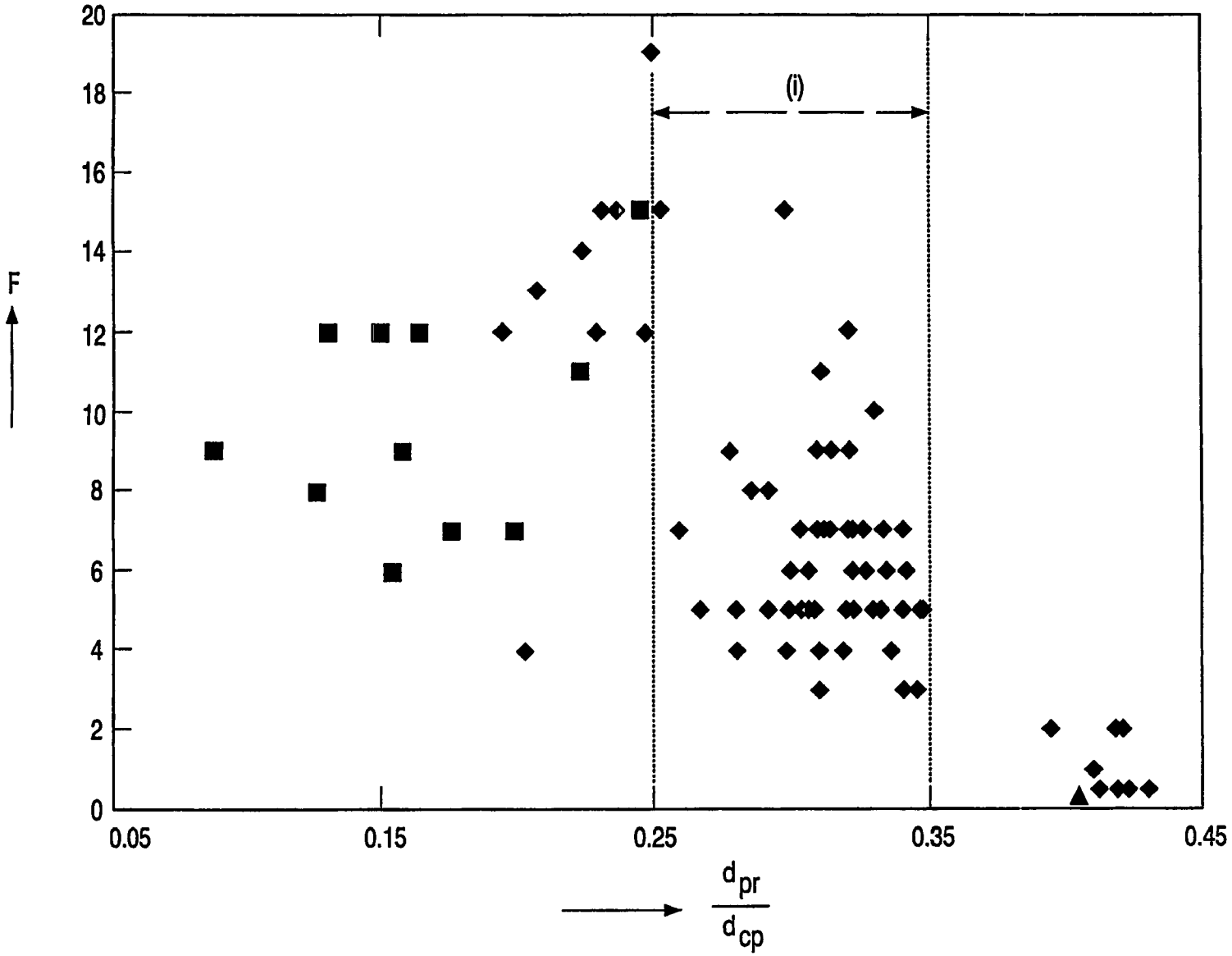
FIG. 3 shows the pulling force as a function of the relative depth dimension of the indentation.

In FIG. 3, the pulling force F (in N) is shown as a function of the relative depth $d_{pr}/d_{cp}$ of the indentation, wherein $d_{pr}$ is the depth of the indentation 15 and $d_{cp}$ is the diameter of the non-deformed contact pin 4 (see FIG. 2A). The pulling force F is the force that is necessary to tear the end portion 51 of the current-supply conductor 5 off the contact pin 4. The relative depth $d_{pr}/p_{cp}$ is also referred to as the pin-pinching depth. In FIG. 3, three kinds of symbols are used:

(a) open squares: after severing of the end portion of the current-supply conductor 5, said current-supply conductor 5 can be moved inside the contact pin 4;

(b) filled triangle: deformation of the contact pin has caused the current-supply conductor 5 to become detached at the side of the current-supply conductor 5 facing the lamp vessel 1;

(c) filled diamonds: the end portion of the current-supply conductor 5 breaks off and can be readily removed from the contact pin 4.

In connection with this, broadly three ranges can be distinguished in FIG. 3:

(a) too small a pin-pinching depth: $d_{pr}/d_{cp}<0.2$. At a pin-pinching depth below the above-mentioned limit, the end portion of the current-supply conductor 5 does not break off, but instead the current-supply conductor 5 moves inside the contact pin 4.

(b) too large a pin-pinching depth: $d_{pr}/d_{cp}>0.4$. At a pin-pinching depth above said limit, the end portion of the current-supply conductor 5 can be readily removed from the contact pin 4. However, during the deformation, the indentation formed in the current-supply conductor at the side facing the lamp vessel 1 is too deep, as a result of which the current-supply conductor 5 may become detached at the lamp side.

(c) a favorable pin-pinching depth: $0.2 \leqq d_{pr}/d_{cp} \leqq 0.4$. At a pin-pinching depth in between said limits, the superfluous end portion of the current-supply conductor 5 can be readily torn off and removed. The fracture in the current-supply conductor 5 occurs near the spot where the indentation 15 is a maximum. The current-supply conductor 5 is sufficiently secured in the indentation 15 and there is no risk that the current-supply conductor 5 will be pulled loose at the side facing the lamp vessel 1.

FIG. 3 shows a very favorable range for the pin-pinching depth by means of vertical dotted lines. In the range indicated by (i), the pin-pinching depth $d_{pr}/d_{cp}$ satisfies the relation:

$$0.25 \leq \frac{d_{pr}}{d_{cp}} \leq 0.35$$

It will be clear that many variations are possible to those skilled in the art within the scope of the invention.

The scope of protection of the invention is not limited to the examples described herein. The invention is embodied in each novel characteristic and each combination of characteristics. Reference numerals in the claims do not limit the scope of the protection thereof. The use of the verb "to comprise" and its conjugations does not exclude the presence of elements other than those mentioned in the claims. The use of the article "a" or "an" in front of an element does not exclude the presence of a plurality of such elements.

The invention claimed is:

1. A capped electric lamp comprising:

a light-transmitting lamp vessel accommodating an electrical element;

a lamp cap provided with a projection contact pin having a longitudinal axis, which lamp is secured to the lamp vessel;

a current-supply conductor which is connected to the electrical element and to the contact pin; and an indentation being formed in the contact pin to fix the current-supply conductor, wherein the indentation comprises a weakening portion for weakening the current-supply conductor during the manufacture of the electric lamp and comprises a fixation portion for fixing the current-supply conductor in the contact pin, wherein the weakening portion and the fixation portion of the indentation are substantially parallel to each other, wherein the indentation between the weakening portion and the fixation portion comprises a narrow portion which is relatively narrow compared with the weakening portion and the fixation portion, and wherein the ratio of the width $w_{np}$ of the narrow portion to the width $w_{wp}$ of the weakening portion complies with the relation:

$$0.2 \leq \frac{w_{np}}{w_{wp}} \leq 0.5.$$

2. A capped electric lamp as claimed in claim 1, wherein the narrow portion lies in a plane which also comprises the weakening portion and the fixation portion.

3. A capped electric lamp as claimed in claim 1, wherein the fixation length $l_{fl}$ of the current-supply conductor in the contact pin is at least 0.75 mm.

4. A capped electric lamp as claimed in claim 1, wherein the current-supply conductor in the contact pin does not extend beyond a boundary of the indentation that is furthest removed from the lamp cap.

5. A capped electric lamp as claimed in claim 1, wherein the contact pin has only one indentation.

6. A capped electric lamp as claimed in claim 1, wherein the lamp has two lamp caps which are each provided with two contact pins.

7. A low-pressure mercury vapor discharge lamp comprising a capped electric lamp as claimed in claim 1, wherein:

the lamp vessel encloses a discharge space provided with a filling of mercury and an inert gas in a gastight manner; and the electric element comprises an electrode arranged in the discharge space for maintaining a discharge in said discharge space.

8. A capped electric lamp comprising:

a light-transmitting lamp vessel accommodating an electrical element;

a lamp cap provided with a projection contact pin having a longitudinal axis, which lamp is secured to the lamp vessel;

a current-supply conductor which is connected to the electrical element and to the contact pin; and an indentation being formed in the contact pin to fix the current-supply conductor, wherein the indentation comprises a weakening portion for weakening the current-supply conductor during the manufacture of the electric lamp and comprises a fixation portion for fixing the current-supply conductor in the contact pin, wherein the weakening portion and the fixation portion of the indentation are substantially parallel to each other, wherein the indentation between the weakening portion and the fixation portion comprises a narrow portion which is relatively narrow compared with the weakening portion and the fixation portion, and wherein the ratio of the width $w_{np}$ of the narrow portion to the width $w_{fp}$ of the fixation portion complies with the relation:

$$0.2 \leq \frac{w_{np}}{w_{fp}} \leq 0.5.$$

9. A capped electric lamp as claimed in claim 8, wherein the fixation length $l_{fl}$ of the current-supply conductor in the contact pin is at least 0.75 mm.

10. A capped electric lamp as claimed in claim 8, wherein the current-supply conductor in the contact pin does not extend beyond a boundary of the indentation that is furthest removed from the lamp cap.

11. A capped electric lamp as claimed in claim 8, wherein the contact pin has only one indentation.

12. A capped electric lamp as claimed in claim 8, wherein the lamp has two lamp caps which are each provided with two contact pins.

13. A low-pressure mercury vapor discharge lamp comprising a capped electric lamp as claimed in claim 8, wherein:

the lamp vessel encloses a discharge space provided with a filling of mercury and an inert gas in a gastight manner; and the electric element comprises an electrode arranged in the discharge space for maintaining a discharge in said discharge space.

14. A capped electric lamp as claimed in claim 8, wherein the narrow portion lies in a plane which also comprises the weakening portion and the fixation portion.

15. A capped electric lamp comprising:

a light-transmitting lamp vessel accommodating an electrical element;

a lamp cap provided with a projection contact pin having a longitudinal axis, which lamp is secured to the lamp vessel;

a current-supply conductor which is connected to the electrical element and to the contact pin; and an indentation being formed in the contact pin to fix the current-supply conductor, wherein the indentation comprises a weakening portion for weakening the current-supply conductor during the manufacture of the electric lamp and comprises a fixation portion for fixing the current-supply conductor in the contact pin, wherein the weakening portion and the fixation portion of the indentation are substantially parallel to each other, wherein the indentation between the weakening portion and the fixation portion comprises a narrow portion which is relatively narrow compared with the weakening portion and the fixation portion, and wherein the ratio of the diameter $d_{ind}$ of the current-supply conductor in the location of the weakening portion in the indentation to the diameter $d_w$ of the current-supply conductor complies with the relation:

$$0.2 \leq \frac{d_{ind}}{d_w} \leq 0.5.$$

16. A capped electric lamp as claimed in claim 15, wherein the fixation length $l_{fl}$ of the current-supply conductor in the contact pin is at least 0.75 mm.

17. A capped electric lamp as claimed in claim 15, wherein the current-supply conductor in the contact pin does not extend beyond a boundary of the indentation that is furthest removed from the lamp cap.

18. A capped electric lamp as claimed in claim 15, wherein the contact pin has only one indentation.

19. A capped electric lamp as claimed in claim 15, wherein the lamp has two lamp caps which are each provided with two contact pins.

20. A low-pressure mercury vapor discharge lamp comprising a capped electric lamp as claimed in claim 15, wherein:

the lamp vessel encloses a discharge space provided with a filling of mercury and an inert gas in a gastight manner; and the electric element comprises an electrode arranged in the discharge space for maintaining a discharge in said discharge space.

* * * * *